US005327758A

United States Patent [19]

Galan

[11] Patent Number: 5,327,758

[45] Date of Patent: Jul. 12, 1994

[54] PIPE BENDING MACHINES

[76] Inventor: Jose M. J. Galan, Estrada Masustegui, 4.-, 48002 Bilbao - Vizcaya, Spain

[21] Appl. No.: 83,662

[22] Filed: Jun. 28, 1993

[51] Int. Cl.[5] ..... B21D 7/04

[52] U.S. Cl. ..... 72/149; 72/157

[58] Field of Search ..... 72/155, 149, 157, 449; 403/359; 29/893.1, 893.2

[56] References Cited

U.S. PATENT DOCUMENTS

| | | | |
|---|---|---|---|
| 1,741,935 | 12/1929 | Harvey | 72/155 |
| 2,223,015 | 11/1940 | Hathorn | 72/155 |
| 3,619,882 | 11/1971 | Sobanski et al. | 403/359 |
| 3,805,552 | 4/1974 | Heald | 403/359 |
| 4,006,993 | 2/1977 | Woerlee | 403/359 |
| 4,098,096 | 7/1978 | Chard et al. | 403/359 |
| 4,502,314 | 3/1985 | Wünsch | 72/449 |
| 4,986,104 | 1/1991 | Caporusso et al. | 72/149 |
| 5,022,249 | 6/1991 | Caporusso et al. | 72/155 |

FOREIGN PATENT DOCUMENTS

| | | | |
|---|---|---|---|
| 0445081 | 9/1991 | European Pat. Off. | 72/157 |
| 2914582 | 10/1979 | Fed. Rep. of Germany | 72/149 |
| 9100227 | 1/1991 | Spain . | |

*Primary Examiner*—David Jones

*Attorney, Agent, or Firm*—Lucas & Just

[57] ABSTRACT

Improvements in pipe bending machines, constructed in a general frame with a die holder shaft that has on its perimeter a flat face and several concave faces angularly out of phase, which produces the bending of pipes, in conjunction with a top die with a displacement guided by means of a motorized device, carrying means for locking in working position.

5 Claims, 2 Drawing Sheets

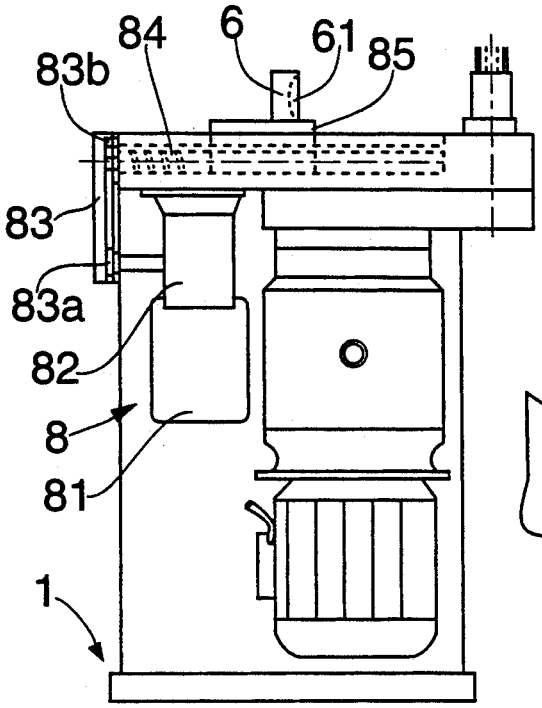
FIG. 4
FIG. 5
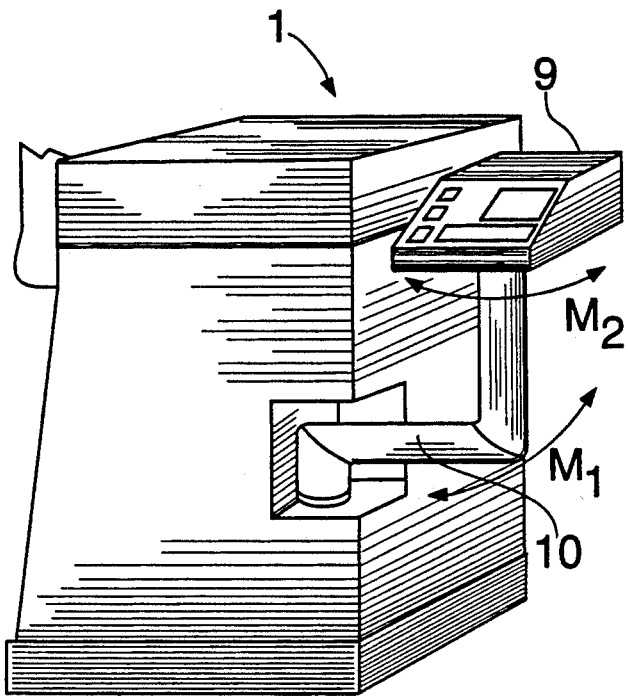
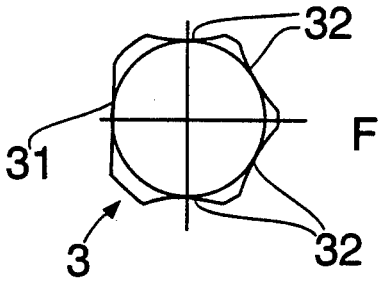
FIG. 3
FIG. 6
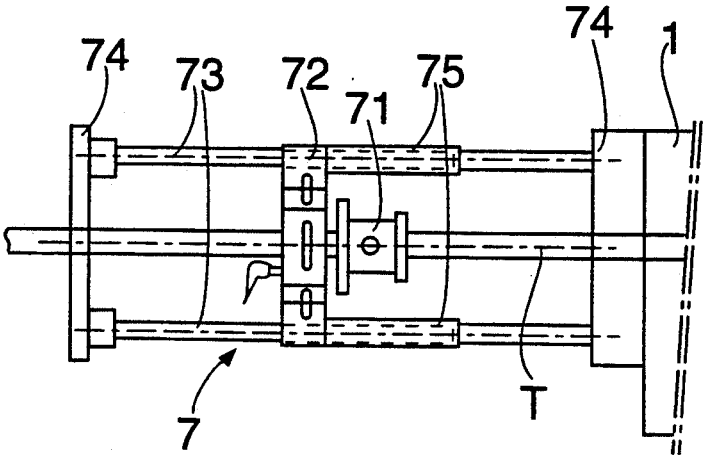

PIPE BENDING MACHINES

FIELD OF THE INVENTION

This invention concerns improvements in pipe bending machines.

Pipe bending machines conventionally offer a complex structure, employing sophisticated mechanisms that even include hydraulic circuits supplying the power necessary to carry out pipe bending.

Machines of simpler construction and portable configuration, like clamps, are also known, marked by the fact that they can only be used to bend pipes of small dimensions that offer little resistance to bending.

The same applicant is holder of Spanish Utility Model 9100227, relating to a pipe bending machine of new construction combined with the manageability of small machines, notably increasing bending strength. It can, consequently, be used to bend pipes of little and medium resistance.

SUMMARY OF THE INVENTION

The improved pipe bending machine of the present invention has a general frame with a rotary shaft on which a die is mounted without being able to turn with respect to the shaft which produces the bending of pipes, in conjunction with a top die displaceable in guides on the general frame and is characterized in that:

a) the die holder shaft is driven by a motor reducer unit and contains on its perimeter a flat face and several concave faces angularly out of phase, being coaxially fastened to the part of the reduction gear by matching, locked by means of a single center bolt;

b) the guided displacement of the top die is achieved by a motorized device and carries means for locking in operating position;

c) the control panel for rotation of the die, guided displacement of the top die and/or regulation of the bending angle is mounted on a support arm coming from the general frame, being independent of same and in ergonomic position;

d) the means for regulation/control of the bending angle are constituted by a pipe holder head, angularly graduated and with means for locking in any angular position in relation to the general frame and/or in relation to guides integrated with said general frame.

The improved pipe bending machine of the present invention is further characterized in that the said motorized device for guided displacement of the top die consists of a motor reducer unit and a chain drive producing the rotation of a spindle on which a clamp is mounted, where the top die is fastened, said clamp being guided in an auxiliary frame or in the main frame of the machine, with the possibility of being locked in its working position.

The improved pipe bending machine of the present invention is furthermore characterized in that the control panel and its support arm contain means for the movement on horizontal planes of the control panel in relation to the arm as well as of the arm in relation to the general frame.

BRIEF DESCRIPTION OF THE DRAWINGS

These and other aspects of the present invention may be more fully understood by reference to the following drawings wherein:

FIG. 3 represents a plan view detail of the die holder shaft (3), showing its perimetric configuration;

FIG. 4 represents a schematic view of the motorized device (8) guiding the top die (6);

FIG. 5 represents a partial schematic view of a pipe bending machine with the improvements according to the invention, showing the support arm (10) and the control panel (9) and its arrangement with respect to the general frame (1) of the machine, for an embodiment in which the panel (9) and support arm (10) contain means for movement in horizontal planes, according to indications ($M_1$), ($M_2$); and FIG. 6 represents a schematic plan view of the means (7) for regulation/control of the bending angle.

DESCRIPTION OF THE PREFERRED EMBODIMENT

Figure 1:
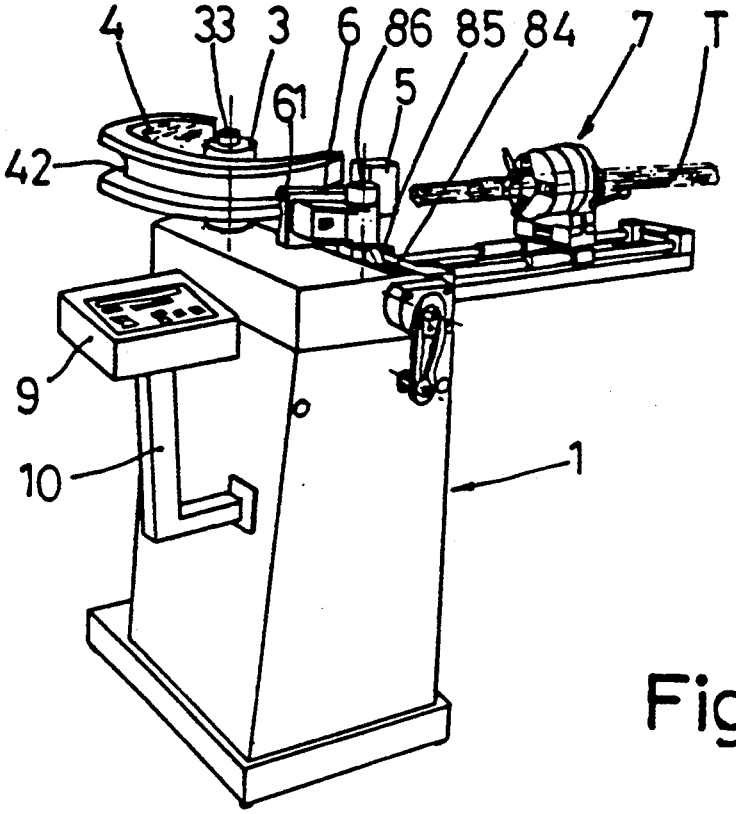
FIG. 1 represents a general schematic view of a pipe bending machine according to the invention, with its basic components in working position, in which the panel (9) is mounted on a support arm (10) that is fixed in relation to the frame (1)

In accordance with the invention, in the embodiment represented, the pipe bending machine includes the following components and/or features: general frame (1); die holder shaft drive means (2); die holder shaft (3); die (4); stirrup (5); top die (6); means of regulation/control of the bending angle (7); and top die drive means (8).

The die (4) can be operated by the drive means (2), which transmit a rotary motion to it through the shaft (3).

Figure 2:
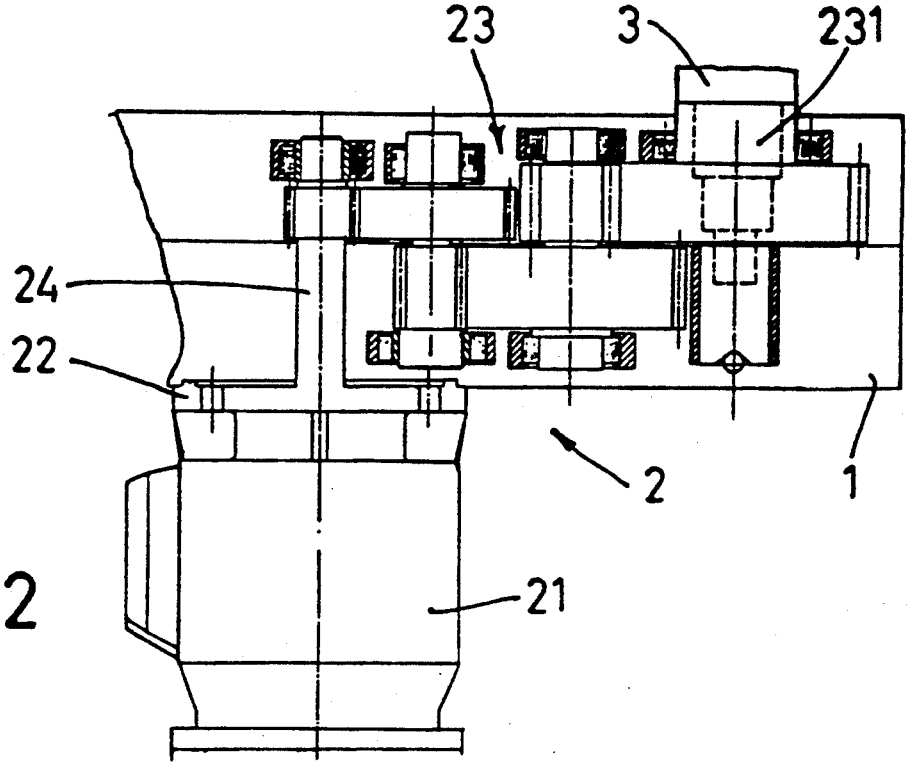
FIG. 2 represents a detailed section of the drive device (2) of the die holder shaft (3)

In accordance with the invention and in the embodiment represented, the means (2) for drive of the die holder shaft (3) are constituted, as represented on FIG. 2, by a motor (21), fastened by means of flanges/screws (22) to the frame (1) of the machine, and a reduction gear (23) consisting of sets of pinions/toothed wheels, which transmits the rotation of the drive shaft (24) to the work shaft, die holder shaft (3).

The die holder shaft (3), as represented on FIG. 3, presents in its perimetric configuration a flat face (31) and various concavities (32) angularly out of phase for the coupled mounting of the die (4) without the die being able to turn with respect to the shaft.

The coaxial mounting of the shaft (3) on the corresponding part (231) of the reduction gear takes place by matching, shaft (3) and part (231) being locked to each other by means of a single center bolt (33).

The die (4) has a stirrup (5) connected to start the bending of the pipe and has a throat (42) of geometry coupled with that of the pipe (T) to be bent.

The top die (6) is mounted on the frame (1) with possibility of linear displacement, for example, in guides being displaced in contraposition to the die (4) driven by appropriate means (8).

In accordance with the invention and in the embodiment represented, the means (8) for drive of the top die (6) are constituted, as represented on FIG. 4, by a motor (81) whose outlet shaft fits an endless reducer/crown (82), a chain drive (83) mounted on two pinions (83*a*), (83*b*), one (83*a*) fastened to the outlet shaft of the endless reducer/crown and the other (83*b*) to a spindle (84).

The spindle (84) fits on a clamp (85), guided in the frame (1) of the machine, or on an auxiliary frame connected to the former, and holding the top die (6).

This arrangement is completed with a block (86) that immobilizes the top die (6) in its working position, in order to achieve greater bending precision.

The top die (6) is preferably of flat configuration, although arched configurations are not ruled out, and also contains a throat (61) of geometry coupled with that of the pipe to be bent which it embraces.

In accordance with the invention and in the embodiment represented, the means (7) for regulation/control of the pipe (T) bending angle are, as represented on FIG. 6, a pipe holder head (71) angularly graduated and with means (72) for being locked and, consequently, locking the pipe (T) in any angular position; guides (73) integrated with the general frame (1) by means of supports (74), on which the head (71) is displaced during pipe (T) bending operations; stops (75) that limit the advance travel of the pipe (T) to be bent, consequently delimiting the zone of bending according to the angle predetermined on the head (71).

In addition, the pipe bending machine, according to this invention, assembles means for commanding/controlling the drive means (2), (8) of the die (4) and (top die) as well as, if necessary, the means (7) for regulation/control of the bending angle.

Such means are combined on a control panel (9) mounted on a support arm (10), said panel (9) and arm (10) going out of the main frame (1) and being mounted either permanently, FIG. 1, or else, FIG. 5, with the possibility of movement on a horizontal plane of the arm (10) in relation to the frame (1), direction ($M_1$), and of the panel (9) in relation to the arm (10), direction ($M_2$).

What is claimed is:

1. An improved pipe bending machine having a general frame with a rotary shaft on which a die is mounted without the die being able to turn with respect to the shaft, which produces the bending of pipes, in conjunction with a top die displaceable in guides on the general frame, the improvement comprising:

a) a die holder shaft which is driven by a motor reducer unit and contains on its perimeter a flat face and several concave faces angularly out of phase, said die holder shaft being coaxially fastened to a part of a reduction gear by matching, said die holder shaft and said part of the reduction gear being locked together by means of a single center bolt;

b) guided displacement of the top die being achieved by a motorized device which includes means for locking said top die in its operating position;

c) a control panel for controlling at least one of rotation of the die, guided displacement of the top die and regulation of the bending angle, said control panel being mounted on a support arm extending from the general frame, and being independent of the general frame; and d) means for regulation/control of the bending angle which is constituted by a pipe holder head, which includes means for locking in at least one of any angular position in relation to the general frame and in relation to guides integrated with said general frame.

2. The improved pipe bending machine of claim 1 wherein said motorized device for guided displacement of the top die consists of a motor reducer unit and a chain drive producing the rotation of a spindle on which a clamp is mounted where the top die is fastened, said clamp being guided in an auxiliary frame of the machine and being capable of being locked in its working position.

3. The improved pipe bending machine of claim 2 wherein the control panel and its support arm contain means for horizontal rotation of the control panel in relation to the arm and of the arm in relation to the general frame.

4. The improved pipe bending machine of claim 1 wherein said motorized device for guided displacement of the top die consists of a motor reducer unit and a chain drive producing the rotation of a spindle on which a clamp is mounted where the top die is fastened, said clamp being guided in the main frame of the machine and being capable of being locked in its working position.

5. An improved pipe bending machine having a general frame with a rotary shaft on which a die is mounted without the die being able to turn with respect to the shaft, which produces the bending of pipes, in conjunction with a top die displaceable in guides on the general frame, the improvement comprising:

a) a die holder shaft which is driven by a motor reducer unit and contains on its perimeter a flat face and several concave faces angularly out of phase, said die holder shaft being coaxially fastened to a part of a reduction gear by matching, said die holder shaft and said part of the reduction gear being locked together by means of a single center bolt;

b) guided displacement of the top die being achieved by a motorized device which includes means for locking said top die in its operating position;

c) a control panel for controlling rotation of the die, guided displacement of the top die and regulation of the bending angle, said control panel being mounted on a support arm extending from the general frame, being independent of the general frame; and d) means for regulation/control of the bending angle which is constituted by a pipe holder head, which includes means for locking in any angular position in relation to the general frame and in relation to guides integrated with said general frame.

* * * * *